US005421574A

United States Patent [19]

Yamagishi et al.

[11] Patent Number: 5,421,574

[45] Date of Patent: Jun. 6, 1995

[54] SPORTS INSTRUMENT AND IMPACT-ABSORBING ELEMENT TO BE ATTACHED TO SPORTS INSTRUMENT

[75] Inventors: Masahiro Yamagishi, Kusatsu; Masao Hijiri, Okazaki; Yasuo Komatsu, Shiga; Hiroshi Edagawa, Shiga; Naoki Imaeda, Otsu, all of Japan

[73] Assignee: Toray Industries, Inc., Tokyo, Japan

[21] Appl. No.: 148,347

[22] Filed: Nov. 8, 1993

Related U.S. Application Data

[60] Division of Ser. No. 993,455, Dec. 16, 1992, Pat. No. 5,314,180, which is a continuation of Ser. No. 684,923, Jun. 18, 1991, abandoned.

[30] Foreign Application Priority Data

| | | | |
|---|---|---|---|
| Aug. 28, 1989 | [JP] | Japan | 1-220632 |
| Jan. 25, 1990 | [JP] | Japan | 2-15859 |
| Feb. 6, 1990 | [JP] | Japan | 2-26431 |

[51] Int. Cl.[6] ..... A63B 53/10

[52] U.S. Cl. ..... 273/80 R

[58] Field of Search ..... 273/75, 735, 67 R, 77 R, 273/81 R, 73 F, 80 R

[56] References Cited

U.S. PATENT DOCUMENTS

| | | | |
|---|---|---|---|
| 1,904,950 | 4/1933 | Roach | 273/80 R |
| 3,537,717 | 11/1970 | Caldwell | 280/601 |
| 3,537,717 | 11/1970 | Caldwell . | |
| 3,762,707 | 10/1973 | Santoelli | 273/80 B |
| 3,792,725 | 2/1974 | Bergson | 273/50.4 X |
| 4,023,801 | 5/1977 | Van Aiken | 473/DIG. 2 |
| 4,212,461 | 7/1980 | Cecka et al. . | |
| 4,309,475 | 1/1982 | Mizaniswa et al. | 273/735 X |
| 4,391,557 | 7/1983 | Saito et al. | 427/385.5 |
| 4,627,635 | 12/1986 | Kolub | 273/735 X |
| 4,660,352 | 4/1987 | Skiner | 273/1 H X |
| 4,684,131 | 8/1987 | Mortvolt | 273/7 SF |
| 4,875,679 | 10/1989 | Morrill et al. | 273/735 X |
| 4,953,861 | 9/1990 | Nakanishi | 273/81 RX |
| 4,933,242 | 1/1991 | Reed | 273/73 X |

FOREIGN PATENT DOCUMENTS

| | | |
|---|---|---|
| 0262891 | 4/1988 | European Pat. Off. . |
| 0344146 | 11/1989 | European Pat. Off. . |
| 1960684 | 6/1970 | Germany . |
| 8501220 | 3/1985 | WIPO . |

*Primary Examiner*—William E. Stoll

*Attorney, Agent, or Firm*—Birch, Stewart Kolasch & Birch

[57] ABSTRACT

This invention relates to sports instruments with which the impact or vibration transmitted to the body such as arms and legs of a user when the instrument is used is largely reduced, and to an impact-absorbing element which is used by being attached on sports instruments. The sports instrument according to the present invention comprises as at least a part of the material constituting a sports instrument a vibration-reducing material having a vibration loss coefficient of not less than 0.01 at room temperature. The impact-absorbing element according to the present invention is to be used by being attached to a sports instrument, which comprises a vibration-reducing material having a vibration loss coefficient of not less than 0.01 as at least a part of the material constituting the element, and has a weight of not less than three grams and a height of not lower than 3 mm, the impact-absorbing element being attached to a sports instrument such that at least an end thereof is free so as to allow the induction of microvibration or micromovement following the vibration and impact transmitted from the outside of the impact-absorbing element.

10 Claims, 9 Drawing Sheets

FIG. 19 (a)
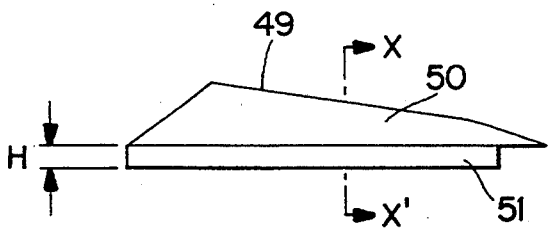
FIG. 19 (b)
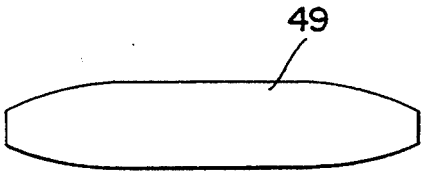
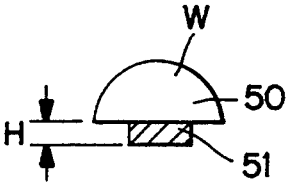
FIG. 19 (c)
FIG. 20
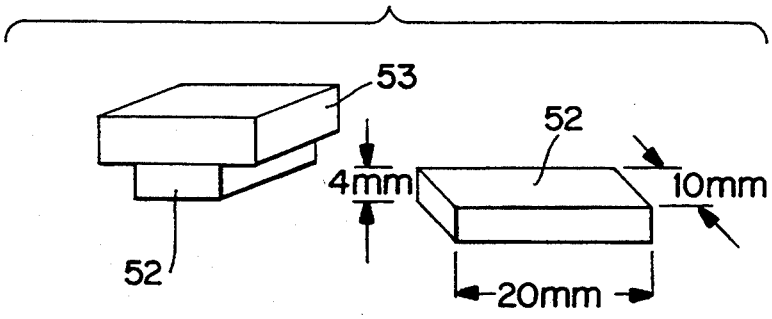

SPORTS INSTRUMENT AND IMPACT-ABSORBING ELEMENT TO BE ATTACHED TO SPORTS INSTRUMENT

This application is a divisional of application Ser. No. 07/993,445 now U.S. Pat. No. 5,314,180, filed on Dec. 16, 1992 which as a continuation of 07/684,923, filed on Jun. 18, 1991, now abandoned, the entire contents of which are hereby incorporated by reference.

TECHNICAL FIELD

This invention relates to sports instruments wherein the impact or vibration transmitted to the body such as arms and legs of users when the instruments are used is largely reduced, and to an impact-absorbing element which is attached to such sports instruments.

More particularly, this invention relates to novel sports instruments such as various rackets for tennis, racket ball and squash, golf clubs, fishing rods, bicycles, skis and baseball bats, wherein the impact transmitted to the users when the instruments are used is reduced. This invention also relates to a novel impact-absorbing element which is appropriately attached to the sports instruments when they are used, which elements exhibit the above-mentioned effect of reducing the impact transmitted to the user even when it is attached to conventional sports instruments of the type mentioned above.

For example, by using a tennis racket of the present invention wherein the impact or vibration generated when hitting a ball is largely reduced, or by using a conventional tennis racket to which an impact-absorbing element of the present invention is attached, the user (tennis player) can enjoy playing tennis preventing a disorder of, viz., "tennis elbow" and the like which the tennis players are likely to suffer from. Further, when the racket hits the ball, and even if the so called "sweet spot" of the racket does not hit the ball, since the impact transmitted vibrations to the hands and the arms of the player are reduced, the player senses the hitting as if the sweet spot of the racket hits the ball, so that the player can play tennis with comfortable hitting and playing feelings.

The present invention particularly relates to sports instruments represented by tennis rackets, with which the impact or vibration transmitted to the body of a user when the instrument is used is largely reduced, and to an impact-absorbing element which is attached to such sports instruments.

TECHNICAL BACKGROUND

Various sports are widely loved and sports instruments specifically adapted to each sport have been used. Various industrial materials have been developed and new materials have been applied to the various sports instruments.

For example, in the field of tennis rackets, recently, there is a trend that larger rackets or rackets with larger frames than before, especially those made of a material which is light but yet has a sufficient strength and rigidity, are increasingly used.

The frames of conventional ordinary tennis rackets are made of wood, fiber-reinforced plastics (FRP) such as glass fiber-reinforced plastics and carbon fiber-reinforced plastics, or metals such as aluminum alloy. Recently, the percentage of those made of plastics, especially fiber-reinforced plastics (FRP) was sharply increased because of the developments in the molding technique, ease of production and due to their good reputation among tennis players.

Although the above-described materials used in the conventional rackets intrinsically have relatively good vibration-damping property, it is not sufficient for sharply and effectively damping the impact and vibration generated when a ball is hit.

Under these circumstances, recently, a large number of people of a wide range of ages have started playing tennis as a light sport. With this sharp increase in the population of tennis players, the number of tennis players suffering from disorders such as "tennis elbow" which is a disorder of elbow is also sharply increased.

It is thought that the disorder called tennis elbow is caused by the impact and vibration generated when a ball is hit with the gut face of a racket, transmitted through the racket frame to the elbow of the player. Especially, when a beginner or a middle class player who is not very good at playing tennis and who cannot properly hit the ball with the sweet spot continues to play tennis with its accompanying unnatural swinging a racket with a large frame made of a light material. (Sweet spot is the central portion of the gut face. If the racket hits a ball with a portion other than the sweet spot, the impact and vibration generated thereby are transmitted to the elbow).

Further, even if the tennis elbow is not caused, the impact and vibration generated by the racket when hitting a ball with a portion other than the sweet spot is transmitted to the hand, arm or elbow of the player and prevent the player from enjoying a comfortable play under sharp and proper hitting and playing feelings. Further, with such a hit force is not properly and effectively transmitted to the ball due to the generation of the impact and vibration, so that powerful and high level techniques cannot be performed. As a result, the fun of playing tennis is reduced.

Thus, the lighter the impact or the vibration from the racket when hitting a ball, the better. Further, if the impact or vibration is light, even if a portion somewhat outside the sweet spot hits the ball, the player feels as if the ball was hit with the sweet spot, so that even beginners can comfortably play tennis with comfortable hitting feelings.

On the other hand, for the purpose of reducing the impact and vibration when hitting a ball, a "stabilizer" has been proposed and is commercially available. The "stabilizer" is a molded article of rubber or soft synthetic resin, and is inserted between adjacent guts or is pressingly attached to the gut face. Although the "stabilizer" is effective for reducing the vibration of the gut per se, it does not function to effectively dampen the vibration transmitted from the gut face to the body of the player via the frame.

As can be seen from the above description, needless to say, it is very important that the frame structure per se effectively damp the impact or vibration transmitted from the gut face to the body of the player through the frame when hitting a ball, and realization of such a racket has been strongly desired with the proviso that the frame structure does not bring about a problem such that the overall weight of the racket is too heavy or the strength of the racket is too low.

Regarding other sports, in most sports in which a sports instrument is handled with the body such as arms or legs, there is a problem caused by the transmission of the impact or the vibration generated by the playing.

For example, the problem that the impact or vibration caused by hitting a ball gives undesirable results also resides in playing golf. Generally, if a ball is hit with the sweet spot of the head portion of a golf club, the ball gains the maximum initial velocity and the flying direction of the ball is also stabilized. On the other hand, if a ball is hit with a portion outside the sweet spot, the club head is rotated about the center of gravity thereof, so that the initial velocity of the ball is decreased and so the flying distance of the ball is decreased accordingly. Further, the direction of the flying out of the ball is shifted and so the ball may fly in an undesirable direction.

To improve the flying distance and flying direction of the ball, several proposals have been made. That is, it has been proposed to adjust the weight distribution of the head portion of a golf club so as to adjust the position of the center of gravity of the head and to increase the moment of inertia of the head (Japanese Utility Publication (Kokoku) No. 53-288). It was also proposed to change the horizontal and vertical lengths of the hitting area of the head portion of a golf club (Japanese Laid Open Utility Model Application (Kokai) Nos. 61-165762 and 63-192474). However, these proposals do not solve the problem of the impact or vibration caused by hitting a ball and do not solve the problem of the uncomfortable palsy feeling and accumulation of fatigue in the wrists, arms and elbows caused by the transmission of the impact and vibration generated when hitting a ball to the player.

Thus, a golf club shaft which has a function to effectively dampen the impact and vibration has been demanded.

To effectively prevent the transmission of impact and vibration to the person handling a sports instrument through the sports instrument, or to effectively damp an external impact and vibration by the properties of the sports instrument is desired in using other sports instruments than tennis rackets and golf clubs. Examples of the such sports instruments include rackets for other than tennis such as for squash, badminton and the like, skis, stocks for skiing, baseball bats, sticks for hockey, ice hockey, gate ball and the like, and bows and arrows for archery, Japanese archery and the like.

DISCLOSURE OF THE INVENTION

The object of the present invention is to provide sports instruments with which the impact and vibration transmitted to the body such as arms and legs of users when the instrument is used is largely reduced, and to provide an impact-absorbing element which is attached to sports instruments, which gives the same effect to sports instruments in use.

With the present invention, sports instruments are provided which per se have the ability to effectively damp the impact and vibration inevitably given to the sports instruments in use. Thus, sports instruments can be realized which give no adverse affects such as the above-mentioned tennis elbow to the body of the player, and with which the player can comfortably play the game fully enjoying the real fun of the sports.

In a first aspect of the present invention, sports instruments which exhibit the above-mentioned effect are provided by employing a specific material as a part of the material of the sports instruments without changing the conventional outer appearance of the instruments. In a second aspect of the present invention, an impact-absorbing element to be attached to a conventional sports instrument as necessary like an attachment, which enables the sports instrument to exhibit the above-mentioned effect even if the sports instrument is a conventional one. The second aspect of the present invention include two basic modes.

The term "sports instrument" herein means any sports instruments as long as the effect of the present invention can be exhibited. Although not restricted, preferred examples of the sports instruments in the present invention include rackets for tennis, racket ball, squash and the-Like; fishing rods; bicycles (frames of bicycles); ball-hitting instruments such as baseball bats and sticks for hockey, ice hockey, gate ball and the like; and bows and arrows for archery, Japanese archery and the like.

The sports instruments according to the first aspect of the present invention are those in which a vibration-reducing material having a vibration loss coefficient at room temperature of not less than 0.01 is used as at least a part of the material constituting the sports instruments.

The impact-absorbing element according to the second aspect of the present invention is an impact-absorbing element to be used by being attached to a sports instrument, which element comprises a vibration-reducing material having a vibration loss coefficient of not less than 0.01 as at least a part of the material constituting the element, and has a weight of not less than three grams and a height of not lower than 3 mm, the impact-absorbing element being attached to a sports instrument such that at least an end thereof is free so as to allow the induction of microvibration or micromovement following the vibration and impact transmitted from the outside of the impact-absorbing element.

The impact-absorbing element of another mode according to the second aspect of the present invention is an impact-absorbing element to be used by being attached to a sports instrument, which element comprises a microvibration-inducing element having a weight of not less than three grams and a height of not lower than 3 mm, which is capable of inducing microvibration or micromovement following the vibration and impact transmitted from the outside of the microvibration-inducing element, and a loading element having a specific gravity of not less than 1.10, which is attached to the microvibration-inducing element.

BRIEF DESCRIPTION OF THE DRAWINGS

FIG. 19 shows the impact-absorbing element which was tested in the examples later described after being attached to the golf club, ski, baseball bat or the fishing rod as shown in FIGS. 15–18, which schematically shows a preferred example of the morphology of the impact-absorbing element according to the present invention, wherein FIG. 19(*a*) is a front view, FIG. 19(*b*) is a plan view and FIG. 19(*c*) is a cross sectional view taken along the X—X′ line shown in FIG. 19(*a*).

FIG. 20 shows the impact-absorbing element tested in the example hereinbelow described after being attached to a tennis racket, which schematically shows a preferred example of the morphology of the impact-absorbing element of the present invention.

BEST MODE FOR CARRYING OUT THE INVENTION

The sports instrument and the impact-absorbing element of the present invention will now be described in more detail.

Figure 1:
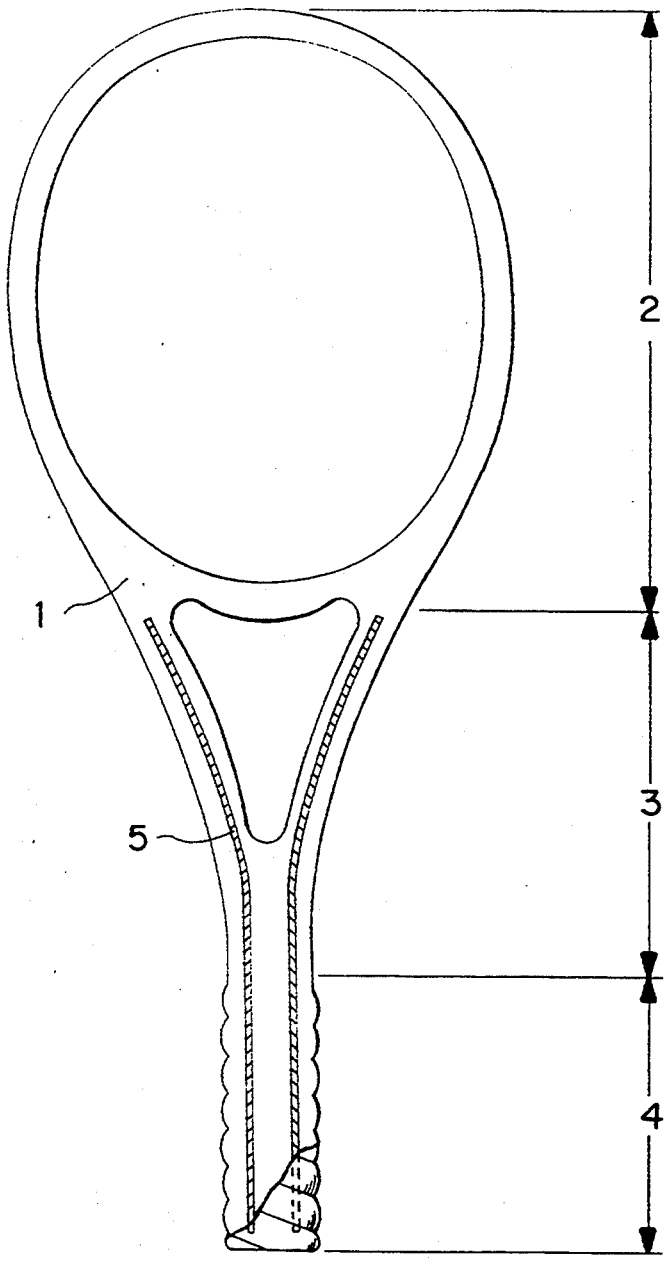
FIGS. 1, 2 and 3 are schematic longitudinal sectional views showing tennis rackets as an example of the sports instrument according to the first aspect of the present invention, wherein the vibration-reducing material is used as a structural material while the outer appearance of the racket is the same as conventional rackets.
Figure 2:
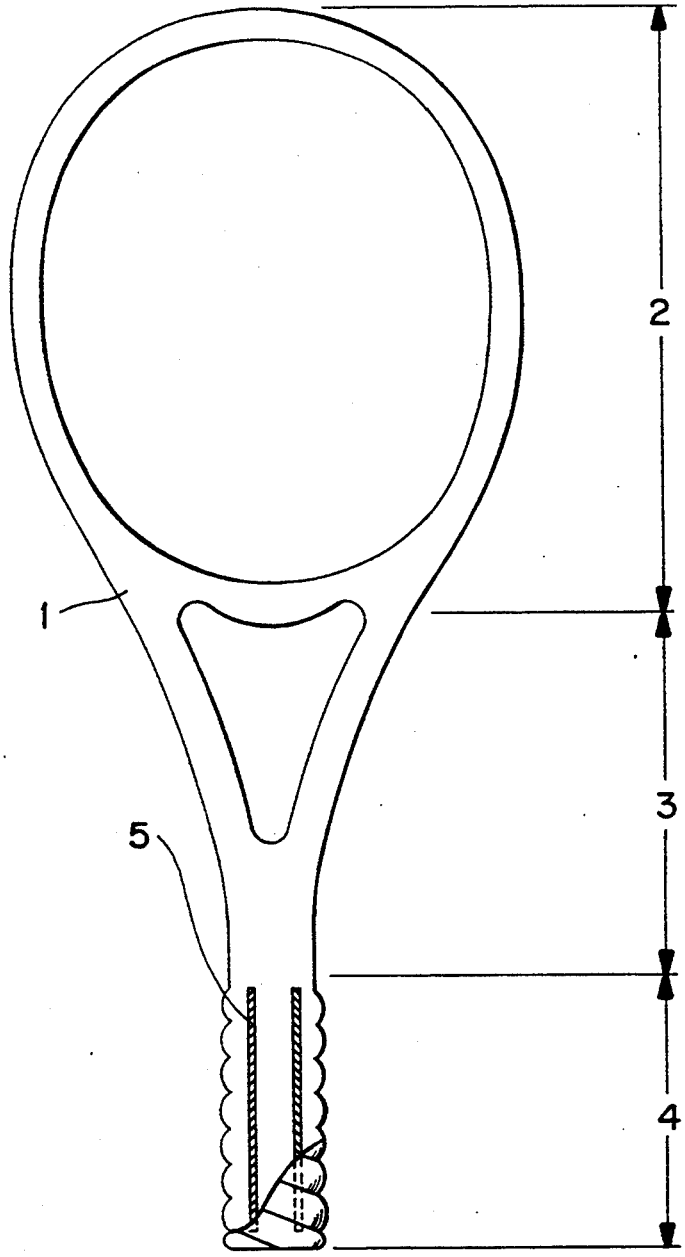
Figure 3:
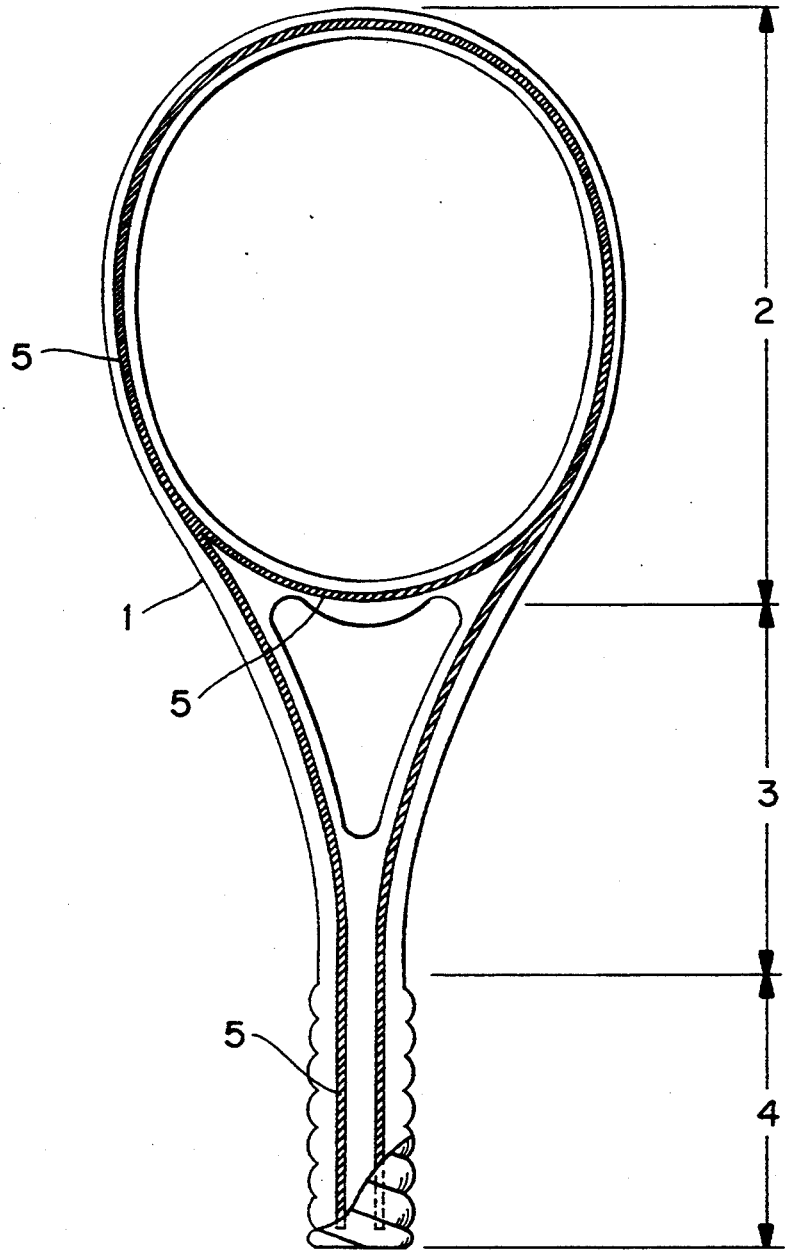

The sports instrument according to the first aspect of the present invention is one in which a vibration-reducing material having a specific vibration loss coefficient is used as at least a part of the material constituting the sports instrument. For example, as shown in FIG. 1, the sports instrument may be a tennis racket 1 comprising a frame portion 2, a throat portion 3 and a grip portion 4, and a vibration-reducing material 5 with a vibration loss coefficient of not less than 0.01 is used as a part of the material constituting the throat portion 3 and the grip portion 4. FIG. 2 shows an embodiment wherein the same vibration-reducing material 5 is used only in the grip portion 4. FIG. 3 shows an example wherein the vibration-reducing material 5 is used as a part of the material constituting the frame portion 2, grip portion 4 and the throat portion 3, that is, almost the entirety of the tennis racket 1.

In the present invention, the vibration-reducing material 5 may be employed in various ways. For example, the sports instrument is mainly composed of a resin and the vibration-reducing material 5 in the form of a sheet, plate, line, block, net, ribbon or the like may be incorporated therein such that the vibration-reducing material 5 and the resin integrally forming the sports instrument. As the resin, fiber-reinforced resins reinforced with carbon fibers and/or glass fibers may preferably be employed. Those sports instruments in which the fiber-reinforced resin forms a layered structure are especially preferred. Among these, according to the finding by the present inventors, those in which the fiber-reinforced resin layer is arranged adjacent to, or in the vicinity of the vibration-reducing material are preferred. Especially, those in which a prepreg containing carbon fibers therein is used as at least a part of the layer of the fiber-reinforced resin, and in which the prepreg is arranged adjacent to, or in the vicinity of the layer of the vibration-reducing material are preferred.

FIGS. 4, 5, 6 and 7 are schematic cross sectional views which schematically show various examples of using the vibration-reducing material with a vibration loss coefficient of not less than 0.01 in sports instruments according to the present invention having their original shape as shown in FIGS. 1–3. For example, schematic cross sectional views showing the frame portion, throat portion or the grip portion of the tennis racket are shown.

Figure 4:
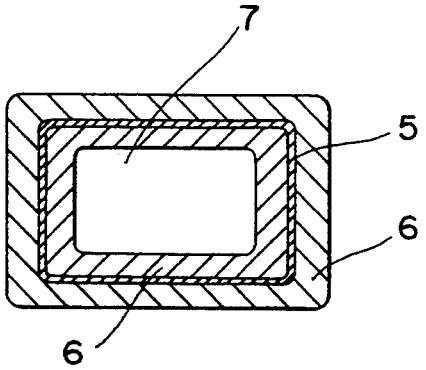
FIGS. 4, 5, 6 and 7 are schematic cross sectional views showing various examples of using the vibration-reducing material in the sports instrument according to the first aspect of the present invention as shown in FIGS. 1–3, wherein the vibration-reducing material with a vibration loss coefficient of not less than 0.01 is used in the sports instrument having the conventional outer appearance.

More particularly, FIG. 4 shows an embodiment in which a layer of the vibration-reducing material 5 with a vibration loss coefficient of not less than 0.01 exists, which is sandwiched between fiber-reinforced resin layers 6. Reference numeral 7 denotes a central space portion. Depending on the desired weight or strength of the sports instrument, the central space portion 7 may be hollow, packed with a foamed resin, or packed with an ordinary or a high density resin.

When it is desired to make the weight of the entire sports instrument as light as possible, a substantially hollow structure, that is, a structure in which the central space portion is hollow or packed with a very light material such as a foamed resin is preferred.

Figure 5:
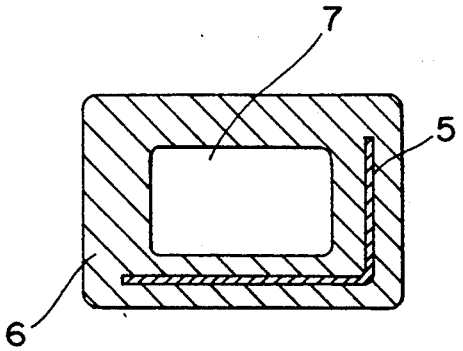

FIG. 5 shows an embodiment wherein a layer of the vibration-reducing material 5 exists only in the adjacent two sides.

Figure 6:
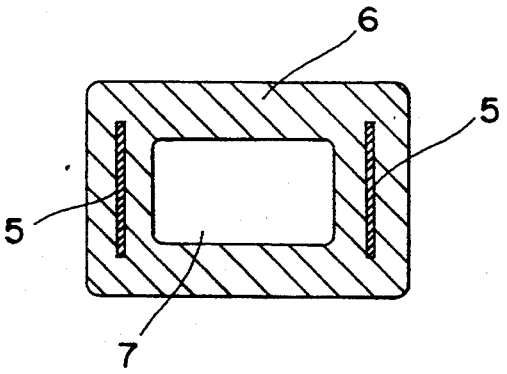

FIG. 6 shows an embodiment wherein layers of the vibration-reducing material 5 exist only in the two sides opposite each other.

Figure 7:
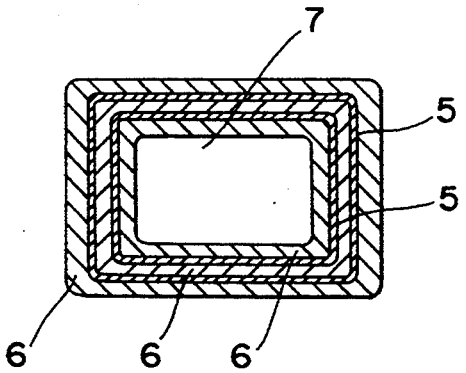

FIG. 7 shows an embodiment wherein two layers of the vibration-reducing material 5 with a vibration loss coefficient of not less than 0.01 are sandwiched among the fiber-reinforced resin layers 6.

Needless to say, a single sports instrument may contain the structures shown in FIGS. 4–7.

The structures shown in FIGS. 4–7 may be formed by laminating the fiber-reinforced resin layers on the vibration-reducing material in the form of a sheet. The fiber-reinforced resin may preferably be a prepreg prepared by impregnating or coating the reinforcing fibers with a resin. Since such prepregs exhibit the stronger reinforcing effect along the running direction of the reinforcing fibers, by appropriately laminating the prepreg so as to arrange the reinforcing fibers in selected directions, the directions in which the reinforcing effect is exhibited can be well balanced.

Such prepregs constitute the main body of the sports instrument. For example, several layers of the prepreg may be wound about a core (hollow or solid metal rod or resin rod), and then a sheet of the vibration-reducing material may be wound thereon. If necessary, additional ply or plies of the prepreg may be wound thereon. The optional number of layers of the vibration-reducing material may be arranged in any part of the sports instrument other than the outermost surface of the sports instrument. It is not preferred to arrange the vibration-reducing material in the outermost surface in view of the strength and ease of molding.

An example of the process of producing the sports instrument of the present invention will now be described by describing an example of the method of such molding.

In a molding method, the rod containing the core rod prepared as mentioned above is heated as it is so as to accomplish the molding.

In another molding method, the above-described core rod is used as the core of the sports instrument as it is. In this case, the core is made of the material to be employed as the core of the sports instrument, and after preparing the wound body mentioned above, the wound body is inserted in a mold, followed by heating so as to carry out the molding. For example, about a core which may be a tube made of a synthetic resin such as Nylon, the prepreg, the vibration-reducing material and the prepreg are wound in the order mentioned, and the resulting wound body is inserted into a metal mold. The molding of the resulting structure may be attained by blowing compressed air into the tube simultaneously with heating so as to shape the tube in conformity with the shape of the metal mold.

In place of such a core material, synthetic resins which are foamed upon heating may be employed as the core material. In this case, after winding the core material with the prepreg and the vibration-reducing material, the molding may be accomplished by heating the resulting structure with or without using a mold so as to foam the resin.

In the present invention, as the vibration-reducing material having a vibration loss coefficient of not less than 0.01 at room temperature, metals with large specific gravities such as lead and copper, elastic rubbers and synthetic resins, as well as mixtures of a synthetic resin and inorganic fillers such as the above-described metals with large specific gravities, graphite, ferrite, mica and the like may be employed.

The metals with large specific gravities may be, for example, metal particles or metal fibers of lead, iron, copper and the like.

As the elastic rubbers, natural rubbers, styrene-butadiene rubbers, isoprene rubbers, chloroprene rubbers and the like may be employed.

As the synthetic resins, polyester resins, polyamide resins, polyvinyl chloride resins, polyvinyl acetate resins, epoxy resins and the like may be employed.

Among the vibration-reducing materials mentioned above, the elastic rubbers and the synthetic resins are preferred because they may easily be. processed into various forms such as a laminate, plate, film, projection and the like and may readily be laminated or composited.

Further, the present inventors found that compositions comprising an epoxy resin, polyamide resin and an organic filler are especially preferred as a vibration-reducing material because they excels in vibration-reducing property. Among these, it is very effective to use a thermally cured material of the following components (a), (b) and (c) as a major constituent: (a) an epoxy resin which shows flowability at a temperature between room temperature and 100° C. (b) a polyamide resin which shows flowability at a temperature between room temperature and 100° C. (c) an inorganic filler selected from the group consisting of graphite, ferrite and mica.

It should be noted that the phrase "which is fluid at a temperature between room temperature to 100° C." means that the resin can take the form of fluid at any one of temperatures from room temperature to 100° C. (e.g., the resin is fluid at 100° C.).

Preferred examples of the epoxy resin (a) which is fluid at a temperature between room temperature and 100° C. include those having at least two glycidyl ether groups, which, more preferably, have a viscosity of 1–300 poises at 25° C. epoxy equivalent of 100–500 and a molecular weight of 200–1000. Specific examples of the preferred epoxy resin include "Epicoat 828", "Epicoat 827", "Epicoat 834" and "Epicoat 807" (all of which are commercially available from Yuka Shell Kagaku Co., Ltd).

As the polyamide resin (b) which is fluid at a temperature between room temperature to 100° C. may preferably be one having a viscosity of 3–2000 poises at 25° C. and an amine value of 100–800 because it effectively acts as a curing agent and as a plasticizer after curing. Specific examples of the preferred polyamide resin (b) include "Tomaide#225-X", "Tomaide#215-X", "Tomaide#225" (these are commercially available from Fuji Kasei Co., Ltd.), "Basamide 930", "Basamide 115" (these are commercially available from General Mills Co., Ltd.) and "Epon-V15" (commercially available from Shell Co., Ltd).

Although the polyamide resin (b) acts as a curing agent of the epoxy resin (a), to further accelerate and promote the curing, conventional curing agents for epoxy resins may be co-employed. Examples of such conventional curing agents include aliphatic amines such as triethyltetramine, propanolamine and aminoethylethanolamine; aromatic amines such as p-phenylenediamine, tris(dimethylamino)methylphenol and benzylmethylamine; and carboxylic acids such as phthalic anhydride and maleic anhydride. The amount of the curing agent to be added may appropriately be selected so as to sufficiently carrying out the curing by taking the epoxy equivalent, amine equivalent and the acid equivalent thereof into consideration.

The inorganic filler (c) to be filled in these resins may preferably be at least one selected from the group consisting of graphite, ferrite and mica. Among these inorganic fillers, graphite is preferred because of the excellent vibration-reducing property. In particular, those with an aspect ratio of 3–70 are preferred. The aspect ratio is the value obtained by dividing the diameter of the particles of the graphite with the thickness thereof. The graphites-having the aspect ratio within the above-described range have good wetting and mixing properties with the resins.

The above-described components may preferably be blended in the mixing ratio as follows:

That is, the amount of the polyamide resin (b) may be 100–800 parts, preferably 200–500 parts with respect to 100 parts of the epoxy resin (a), and the amount of the inorganic filler (c) may be 30–120 parts, preferably 40–100 parts with respect to 100 parts of the total amount of the resins (in cases where the monoglycidyl ether is blended, the monoglycidyl ether is also included in the total amount of the resins).

To add a monoglycidyl ether compound to the resin composition described above is preferred because a vibration-reducing material which is very flexible and has good processability, which also has a great vibration-reducing property may be obtained. Preferred monoglycidyl ether compounds include those having an epoxy equivalent of 80–400 and a molecular weight of 80–400. Specific examples of the preferred monoglycidyl ether compounds include octadecylglycidyl ether, phenylglycidyl ether and butylphenylglycidyl ether.

The amount of the monoglycidyl ether compound to be added to the resin composition may preferably be 5–45 parts, more preferably 10–25 parts with respect to 100 parts of the epoxy resin.

Among the vibration-reducing materials to be employed in the present invention, those having a vibration loss coefficient of not less than 0.02, more preferably not less than 0.04 at room temperature, 20° C., in the frequency range of 50 Hz to 5 kHz, are preferred.

In the present invention, the vibration loss coefficient may be measured as follows:

That is, a sample resin (vibration-reducing agent) with a thickness of 10 mm is adhered to a steel plate of 5 mm thickness with a two-liquid type epoxy adhesive and the resultant is left to stand for 24 hours. Thereafter, according to the U.S. Army Standard MIL-P-22581B, the vibration decay waveform is measured at room temperature (20° C.), and the vibration loss coefficient (72 ) is calculated according to the equation below described. The measurement is repeated twice and the average is calculated.

a. Decay Rate $D_0$ (dB/sec)$=(F/N)\cdot 20\cdot\log(A_1/A_2)$ b. Effective Decay Rate De (dB/sec)$=D_0-D_B$ c. Percent Critical Damping C/Cc (%)$=(183\times De)/F$ wherein F represents the proper frequency of the sample-adhered plate, N represents the number of periods taken into the calculation, $A_1$ represents the maximum amplitude in N, $A_2$ represents the minimum amplitude in N, $D_0$ represents the decay rate of the sample-adhered plate, $D_B$ represents the decay rate of the original steel plate.

d. Vibration Loss Coefficient ($\eta$) $\eta=(C/Cc)/50$

The above-described fiber-reinforced resin to be composited with the vibration-reducing material may preferably has a high strength and high rigidity sufficient as a structural material of the sports instrument. As the matrix resin of the fiber-reinforced resin, thermoplastic resins and thermosetting resins may be employed, while thermosetting resins are preferred in view of the high rigidity. The thermosetting resins which may be used include epoxy resins, unsaturated polyester resins, phenol resins, urea resins, melamine resins, diallylphthalate resins, urethane resins and polyimide resins as well as mixtures thereof. Among these, epoxy resins and unsaturated polyester resins are especially preferred.

The thermoplastic resins which may be used include polyamide resins, polyester resins, polycarbonate resins, ABS resins, polyvinyl chloride resins, polyacetal resins, polyacrylate resins, polystyrene resins, polyethylene resins, polyvinyl acetate resins and polyimide resins as well as mixtures thereof.

These fiber-reinforced resins may preferably be reinforced with reinforcing fibers such as inorganic fibers including metal fibers, carbon fibers and glass fibers, and synthetic fibers such as aramide fibers and other high tension synthetic fibers. The fibers may be used for reinforcement individually or in combination and may be long fibers, short fibers or mixtures thereof.

In the present invention, the vibration-reducing material is generally employed in the amount of 1/5–1/100% based on the total weight of the sports instrument. In case of a tennis racket, although not restricted, the vibration-reducing material may preferably be employed in the amount of 1/7–1/80% based on the total weight of the racket (including the gut).

If the transmission of the impact and the vibration is too much reduced, the sound of hitting a ball is also reduced accordingly, so that some players may not be satisfied with the feeling of hitting a ball. Thus, if a part of the transmission of the impact and vibration is desired to be reserved, the amount of the vibration-reducing material may be limited or the use of the vibration-reducing material may be restricted to only a limited portion of the sports instrument.

With the sports instrument according to the present invention mentioned above, the vibration-reducing material very effectively and sharply damps the impact and vibration, so that the fatigue of the arms, elbows, legs and the like as well as the disorders caused by the shocks may effectively be prevented.

The impact-absorbing element according to the second aspect of the present invention, which is to be used by being attached to conventional sports instruments like an attachment will now be described.

Figure 8:
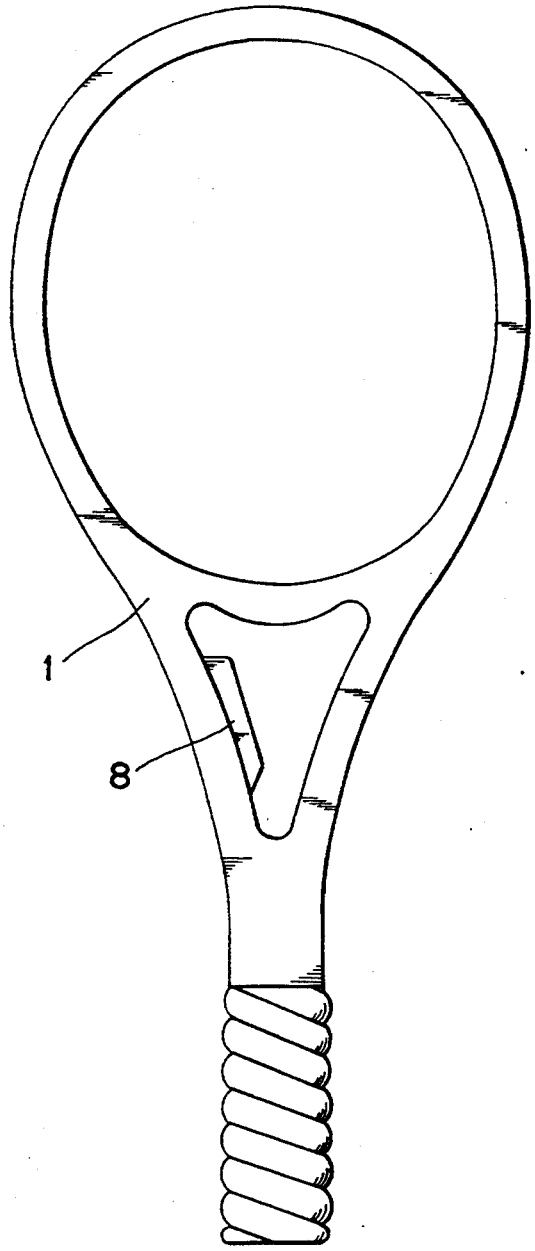
FIG. 8 is a schematic view showing the impact-absorbing element according to the second aspect of the present invention attached to a conventional tennis racket like an attachment.

The impact-absorbing element of the present invention has two basic modes. The impact-absorbing element according to the first mode comprises a vibration-reducing material having a vibration loss coefficient of not less than 0.01 as at least a part of the material constituting the element, and has a weight of not less than three grams and a height of not lower than 3 mm, which is attached to a sports instrument such that at least an end thereof is free so as to allow the induction of microvibration or micromovement following the vibration and impact transmitted from the outside of the impact-absorbing element. For example, as schematically shown in FIG. 8, the impact-absorbing element 8 of the present invention is attached to the vicinity of the throat portion 3 or the like.

In the impact-absorbing element of the present invention, as the vibration-reducing material with a vibration loss coefficient of not less than 0.01, the above-described vibration-reducing material which may be used as a structural material in the first aspect of the present invention may be employed. In particular, elastic rubbers, various elastomers, synthetic resins and the above-described thermally cured composition comprising as major components the epoxy resin (a), polyamide resin (b) and the inorganic filler (c) are preferred because these materials may easily be processed into various forms such as a laminate, plate, film, projection and the like and may readily be laminated or composited.

The impact-absorbing element of the present invention is capable of inducing microvibration or micromovement following the vibration and impact transmitted from the outside thereof. The microvibration or micromovement is induced with a short time lag from the impact and vibration actually given to the sports instrument so that the induced microvibration or micromovement neutralizes the original vibration. As a result, the original vibration energy given to the sports instrument is absorbed or diffused so as to be instantly reduced.

In order to be capable of inducing such microvibration or micromovement, the impact-absorbing element has to have at least a certain height and weight. In view of this, for use with the sports instruments used in the above-described sports, it is important that the impact-absorbing element have a weight of not less than three grams and a height of not lower than 3 mm. It is also important that the impact-absorbing element be attached to the sports instrument such that at least an end thereof is free So as to allow the induction of microvibration or micromovement following the vibration and impact transmitted from the outside of the impact-absorbing element.

Although the position at which the impact-absorbing element is attached is not restricted, it is preferred to attach the impact-absorbing element in the vicinity of the center of gravity of the sports instrument. For example, in case of tennis rackets, since the tennis rackets generally have the center of gravity in the vicinity of the throat portion, it is preferred to attach the impact-absorbing element in the vicinity of the throat portion. It should be noted, however, the impact-absorbing element may be attached to the vicinity of the frame portion to the gut. Attaching the impact-absorbing element to the gut is quite effective. Needless to say, even if the impact-absorbing element is to be attached to the gut, the impact-absorbing element has to have a weight of not less than three grams and a height of not lower than 3 mm, and it is important to attach the impact-absorbing element such that at least an end thereof is free so as to allow the induction of microvibration or micromovement following the vibration and impact transmitted from the outside of the impact-absorbing element. In cases where the impact-absorbing element is to be attached to a racket, it is practical that the weight of the impact-absorbing element be in the range of 1/7 to 1/80 of the total weight (including the gut) of the racket. Generally speaking, the impact-reducing material is preferably used in the amount of 1/5–1/100 based on the total weight of the sports instruments including those other than rackets.

In the impact-absorbing element of the present invention, the vibration-reducing material may preferably be a single or a plurality of rubberlike elastomers having a 50% modulus value of 0.5–200 kg/cm$^2$. If the impact-absorbing element is made of a rubberlike elastomer with a 50% modulus value within this range, microvibration is very quickly generated in response to the impact and vibration and the shifted vibration against the original vibration may effectively be generated.

Alternatively, the impact-absorbing material of the present invention may be a combination of a single or a plurality of rubberlike elastomers having a 50% modulus value of 0.5–200 kg/cm$^2$ with a metal and/or a variety of resin materials. By employing such a combined structure, an impact-absorbing element with excellent microvibration-inducing property may be attained.

The principle of the impact-absorbing element of the present invention as well as the various examples of shapes and structures of the first mode are shown in FIGS. 9–12.

Figure 9:
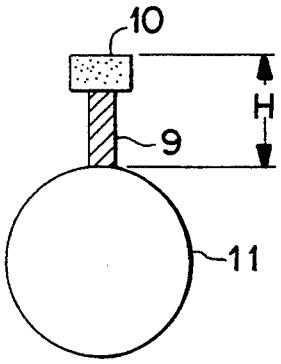
FIGS. 9–12 show various examples of shapes and structures of the impact-absorbing element according to the first mode of the second aspect of the present invention.

The constitution of the present invention will now be firstly described referring to FIG. 9 in these drawings. Microvibration-inducing elements 9 and 10 are connectively provided on the surface of a vibration source object 11 (e.g., a racket).

The conjugate of the microvibration-inducing elements 9 and 10 is the impact-absorbing element of the present invention. With this mode, the impact-absorbing element follows the impact and vibration transmitted from the vibration source object 11 (racket or the like) and induces microvibration or micromovement generating a small time lag from the transmitted impact and vibration so as to neutralize the original vibration, thereby absorbing or reducing the vibration energy.

Figures 10A, 10B, 10C:
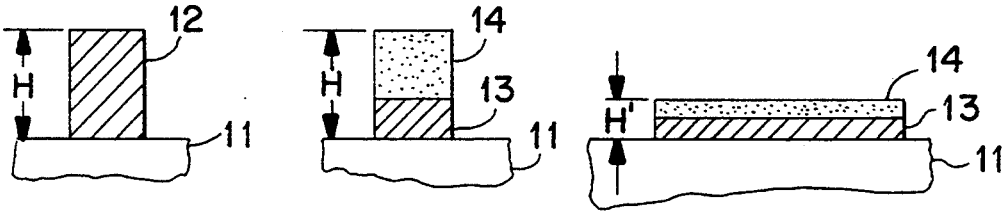

In FIG. 10, all of (a), (b) and (c) are views for explaining the embodiments of the microvibration-inducing element directly attached to the vibration source object 11. (a) shows an embodiment wherein the microvibration-inducing element 12 is made of a single material, and (b) and (c) show embodiments wherein the microvibration-inducing element is composed of a combination of a microvibration-inducing element 13 and a microvibration-inducing element 14. That is, in (a) - (c), each portion having a hatching denotes a single microvibration-inducing material. Thus, in the embodiments shown in (b) and (c), the microvibration-inducing element is composed of a combination of two materials. Thus, in the present invention, the microvibration-inducing element may be constituted by a combination of a plurality of microvibration-inducing elements, and in the first mode, the entirety of the combination of a plurality of microvibration-inducing elements constitutes the impact-absorbing element of the present invention.

In the present invention, as shown in FIG. 10(*a*) and (*b*), the impact-absorbing material may have a height H in the direction perpendicular to the vibration source object 11, which is larger than the width of the contact surface between the microvibration-inducing element and the vibration source object 11. Alternatively, as shown in FIG. 10(*c*), the impact-absorbing material may have a height H' in the direction perpendicular to the vibration source object 11, which is smaller than the width of the contact surface between the microvibration-inducing element and the vibration source object 11. In either of these embodiments, it is important that the height H or H' be not less than 3 mm.

Figures 11A, 11B, 11C:
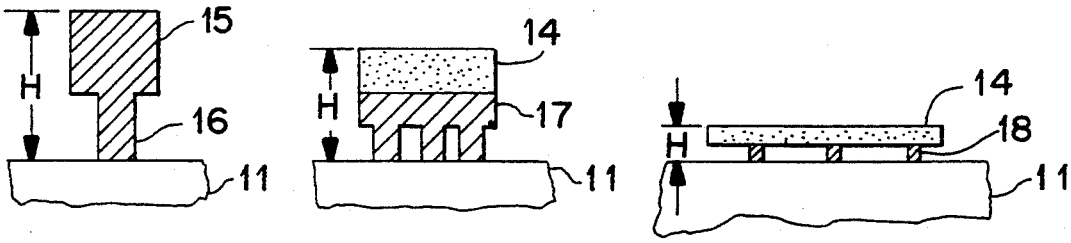

FIG. 11(*a*), (*b*) and (*c*) show modifications of the embodiments shown in FIG. 10, which are designed so that the microvibration can be more effectively induced than by the embodiments shown in FIG. 10. In these embodiments shown in FIG. 11, one or more squeezed portions or one or more neck portions are formed in the vicinity of the vibration source to which one end of the vibration-absorbing element is fixed. More particularly, in the embodiment shown in Fig. 11(*a*), the lower end portion 16 of the element 15 is squeezed. In the embodiment shown in FIG. 11(*b*), the element is constituted by a combination of the elements 14 and 17, and the lower end portion of the element 17 is constituted by three thin leg-like portions. In the embodiment shown in FIG. 11(*c*), to the lower end portion of a vertically elongated element 14, three thin connective elements 18 are provided.

It is preferred to constitute the elements 15, 17 and 18 with a single vibration-reducing material and to constitute the element 14 with another vibration-reducing material.

Figure 12A:
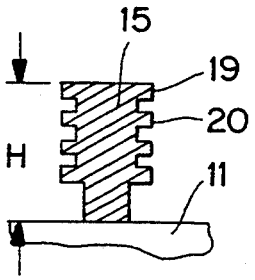
Figure 12B:
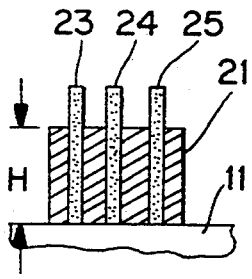
Figure 12C:
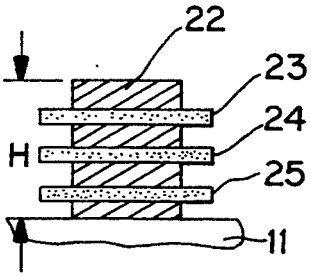

FIGS. 12(*a*), (*b*) and (*c*) are for explaining other embodiments wherein slit-like configurations or uneven configuration is given to the side or a portion of the surface of the impact-absorbing element so as to enable the impact-absorbing element more effectively inducing microvibration. FIG. 12(*a*) shows an embodiment in which projections 19 and 20 are formed on the side of the element 15. FIG. 12(*b*) and (*c*) show embodiments in which slit-like portions 23, 24 and 25 are incorporated perpendicularly or horizontally to the main body 21 and 22 of the element. With these structures, by forming the elements 23, 24 and 25 with a material other than that constituting the elements 21 and 22 or by appropriately selecting the size of the elements 23, 24 and 25, the microvibration may be induced more suitably in response to the vibration from the vibration source element 11. Thus, the length, thickness, surface area, weight, rigidity and the height of the projections from the side face (wall) of the elements 21 and 22 and like of the elements 23, 24 and 25 may be appropriately selected. The elements 23, 24 and 25 may be made of a metal and/or a variety of resin materials.

The impact-absorbing element according to the second mode comprises a microvibration-inducing element having a weight of not less than three grams and a height of not lower than 3 mm, which is capable of inducing microvibration or micromovement following the vibration and impact transmitted from the outside of the microvibration-inducing element, and a loading element having a specific gravity of not less than 1.10, which is attached to the microvibration-inducing element.

This impact-absorbing element, like the impact-absorbing element according to the first mode, instantly induces microvibration so as to neutralize the original impact and vibration.

More particularly, in such an impact-absorbing element, the microvibration-inducing element mainly acts in the same manner as in the vibration-reducing material in the above-described first mode. However, in the second mode, since the loading element with a specific gravity of not less than 1.10 is attached, microvibration or micromovement is more readily be induced following the vibration or impact transmitted from the outside. Therefore, the microvibration-inducing element need not to have a vibration loss coefficient of not less than 0.01. In order to obtain such an effect, it is important that the loading element have a specific gravity of not less than 1.10. It is required, however, that the microvibration-inducing element is necessary to have a weight of not less than three grams and a height of not lower than 3 mm in order to induce the microvibration or micromovement well. The weight and the height mentioned here are the weight and height of the microvibration-inducing element which does not include the loading element W. Needless to say, the microvibration-inducing element may have a vibration loss coefficient of not less than 0.01 and this is a preferred mode.

Figure 13A:
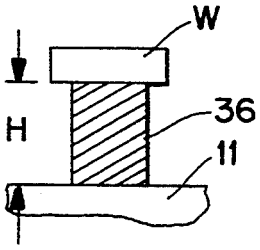
FIGS. 13 and 14 show various examples of shapes and structures of the impact-absorbing element according to the second mode of the second aspect of the present invention, in which a loading element is co-used.
Figure 13B:
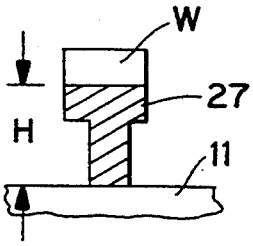
Figure 13C:
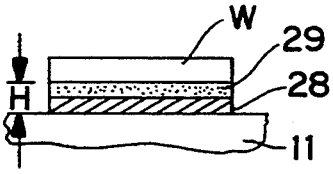
Figure 14A:
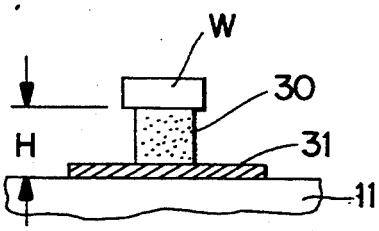
Figure 14B:
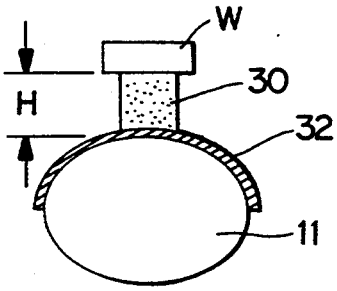

The impact-absorbing element according to the second basic mode of the present invention as well as the various examples of the shapes and structures thereof are shown in FIGS. 13(*a*), (*b*) and (*c*) and FIGS. 14(*a*) and (*b*).

FIGS. 13 (*a*), (*b*) and (*c*), show embodiments of the impact-absorbing elements of the present invention in which microvibration-inducing element 26, 27, 28 or 29 which induces microvibration or micromovement following the vibration and impact transmitted from the vibration source object 11 (racket or the like) is combined with a loading element W made of a material having a prescribed specific gravity, which is attached to the microvibration-inducing element. In these embodiments, one end of the loading element W is free so that the induction of the microvibration or micromovement of the microvibration-inducing elements 26, 27, 28 and 29 is more effectively attained.

FIGS. 14(*a*) and (*b*) show embodiments with which the manner of attaching the microvibration-inducing element 30, 31 or 32 to the vibration source object 11 is designed so as to effectively induce the microvibration or micromovement following the impact and vibration transmitted. More particularly, elements 31 and 32 in the form of a plate are made of an appropriate material such as a rubber or elastomer and are mounted on the vibration source object 11 horizontally or circularly. With this structure, the microvibration-inducing element can effectively induce microvibration or micromovement quickly following the vibration from the vibration source. It should be noted that even in cases where the plate-like element is provided, the height of the microvibration-inducing element is measured from the side wall portion of the vibration source object 11.

The micromovement-inducing element may be made of any material which can induce the microvibration following the vibration transmitted from the vibration source. It is preferred, however, to constitute the microvibration-inducing element with a single or a plurality of rubberlike elastomers with a 50% modulus value of 0.5–200 kg/cm$^2$. More particularly, organic elastomers, that is, resins such as polyvinyl chlorides, polyurethanes, polyamides, polystyrenes, ethylene vinyl chloride copolymers, ethylene ethylacrylate copolymers, polyolefins, polyesters, epoxy resins and the like, and rubber elastomers, that is, for example, natural rubbers, styrene-butadiene rubbers, nitrile rubbers, isoprene rubbers, hydrine rubbers and chloroprene rubbers and the like may be employed. Further, foamed plastics such as polyurethanes, polystyrenes, polyethylenes, fluoride resins, EVA resins, phenol resins, PVC resins, polyurea resins and the like may be employed.

It should be noted here that the 50% modulus (stress at 50% elongation) may be measured according to the physical testing method of vulcanized rubbers defined in JIS K-6301. That is, a test sample in the form of No. 3 dumbbell-shape with a thickness of 4 mm is elongated by 50% and the load necessary for elongating the sample by 50% is measured. The 50% modulus ($M_{50}$) is calculated according to the following equation:

$$M_{50} = \frac{Fn}{A}$$

wherein $M_{50}$ represents the stress (kgf/cm$^2$) at 50% elongation, Fn represents load (kgf) at 50% elongation, and A represents the cross sectional area (cm$^2$) of the test sample.

The impact-absorbing element according to the second basic mode may be used in the same manner as in the impact-absorbing element according to the first basic mode.

That is, in general, it is preferred to attach the impact-absorbing element in the vicinity of the center of gravity of the sports instrument. In cases where the impact-absorbing element is to be attached to a racket, it is practical that the weight of the impact-absorbing element be in the range of 1/7 to 1/80 of the total weight (including the gut) of the racket. Generally speaking, the impact-reducing material is preferably used in the amount of 1/5–1/100 based on the total weight of the sports instruments including those other than rackets.

The impact-absorbing element may be attached by adhering, pasting or fixing means such as an adhesive or fixing agent, or by appropriate attaching or mounting means such as a rubber band, and may be attached to the sports instrument only when using the instrument.

Figure 15:
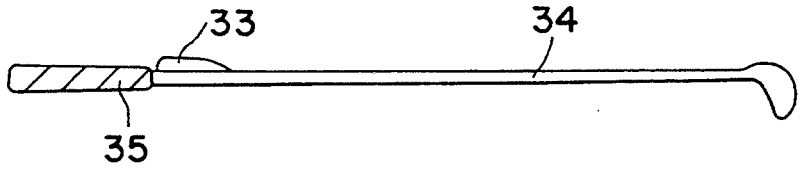
FIG. 15 is a schematic view showing the impact-absorbing element according to the second aspect of the present invention attached to a conventional golf club like an attachment.

The above-described impact-absorbing element exhibits, of course, its effect even if it is attached to a conventional golf club like an attachment. In this case, as shown in FIG. 15, the impact-absorbing element may be attached in the vicinity of the grip or the center of gravity of the golf club.

The sports instruments according to the present invention as well as the sports instruments to which the impact-absorbing element of the present invention is attached exhibited apparent vibration loss coefficient measured by the method later described of 0.03 or more, or even 0.04 or more, needless to say 0.01 or more. Thus, the present invention enables to use above-described various sports instruments under exhibiting the excellent impact-reducing effect.

Figure 16:
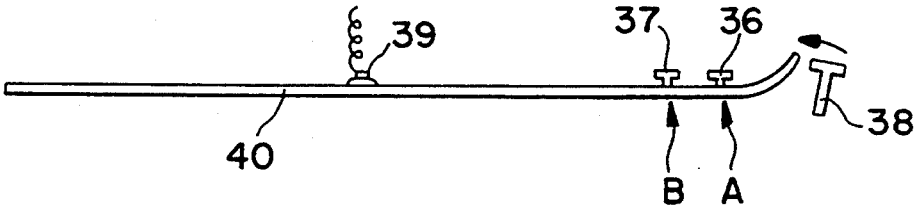
FIG. 16 is a schematic view showing the impact-absorbing element according to the second aspect of the present invention attached to a conventional ski like an attachment, which also shows the method of measuring the vibration loss coefficient of the ski, that is employed in the example later described.
Figure 17:
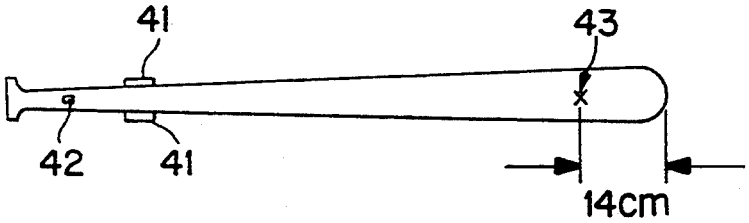
FIG. 17 is a schematic view showing the impact-absorbing element according to the second aspect of the present invention attached to a conventional baseball bat like an attachment, which also shows the method of measuring the vibration loss coefficient of the baseball bat, that is employed in the example later described.
Figure 18:
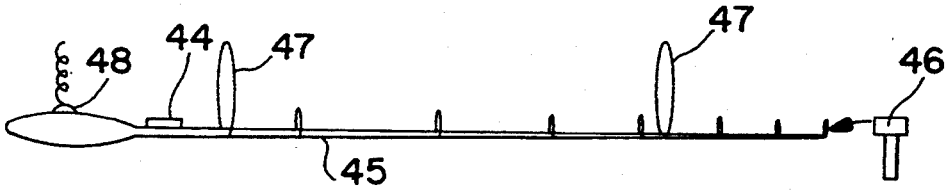
FIG. 18 is a schematic view showing the impact-absorbing element according to the second aspect of the present invention attached to a conventional fishing rod like an attachment, which also shows the method of measuring the vibration loss coefficient of the fishing rod, that is employed in the example later described.

An embodiment in which the impact-absorbing element is attached to a ski is schematically shown in FIG. 16. An embodiment in which the impact-absorbing element is attached to a baseball bat is schematically shown in FIG. 17. An embodiment in which the impact-absorbing element is attached to a fishing rod is schematically shown in FIG. 18. In these figures, the methods of measuring the apparent vibration loss coefficient of the sports instruments which will be described later are also explained.

The present invention will now be described in more concretely by way of examples thereof.

In the examples, the apparent vibration loss coefficient of the each sports instrument was measured by the method as follows:

(1) Method for Measuring Apparent Vibration Loss Coefficients of Rackets

The sample racket according to the present invention or the sample racket to which the impact-absorbing element of the present invention is attached is provided with a microacceleration pickup at the center of the grip portion. The tip of the frame is lightly hit with a hammer and the decay waveform of the generated vibration is measured with an FET analyzer (commercially available from Ono Sokuki Co., Ltd). The measured waveform is processed with a microcomputer and the vibration loss coefficient ($\eta$) was calculated according to MIL-P-22581B.

(2) Method for Measuring Apparent Vibration Loss Coefficients of Golf Clubs

A microacceleration pickup is mounted on the center of the grip portion of the sample golf club and the center of the head is lightly hit with a hammer. In the same manner as in the measurement of the vibration loss coefficients of rackets, the vibration loss coefficient is determined using the decay waveform.

(3) Method for Measuring Apparent Vibration Loss Coefficients of Skies

As shown in FIG. 16, impact-absorbing elements 36 and 37 are adhered to the point A which is the junction between the linear portion and the curved tip portion of the ski, and to the point B which is a little closer to the center to the ski than the point A, respectively. A microacceleration pickup 39 is mounted on the center of the footrest and the tip of the ski is lightly hit with a hammer 38. The vibration loss coefficient was measured as in the measurement of the vibration loss coefficients of rackets.

(4) Method for Measuring Apparent Vibration Loss Coefficients of Baseball Bats

As shown in FIG. 17, one or two impact-absorbing elements 41 are mounted on the point 1–2 cm apart from the grip tape of the bat and an acceleration pickup is mounted on the center 42 of the grip. The point 43 which is 14 cm apart from the tip of the bat is lightly hit with a hammer and the vibration loss coefficient is measured in the same manner as in the measurement for the rackets.

(5) Method for Measuring Apparent Vibration Loss Coefficients of Fishing Rods

As shown in FIG. 18, to a fishing rod 45, an impact-absorbing element 44 and an acceleration pickup 48 are attached and the thread-guiding portion at the tip of the fishing rod 45 is lightly hit with a hammer 46. The vibration loss coefficient is measured in the same manner as in the measurement for the rackets. In the measurement, two points of the fishing rod is hung with hanging ropes 47.

EXAMPLE 1

Epoxy resin-based prepregs containing 65% by weight of fibers including glass fibers made of E glass and carbon fibers at a weight ratio of 80:20, which prepregs had a weight per a unit area of 350 g/m$^2$ were prepared. Two of the thus obtained prepregs were laminated such that the reinforcing fibers of each prepreg cross at right angles to obtain a prepreg sheet. The thus obtained prepreg sheet was used as the material for constituting a racket.

On the other hand, a resin composition having the following composition was cast and cured to obtain a resin sheet of 0.2 mm thickness. The thus obtained sheet was used as the vibration-reducing material.

| | |
|---|---|
| Epoxy Resin (Epicoat#828, commercially available from Yuka Shell Co., Ltd.) | 16.3 parts |
| Octadecylglycidyl Ether | 3.2 parts |
| Polyamide Resin (Tomaid#225-X, commercially available from Fuji Kasei Co., Ltd) | 38.3 parts |
| Tris(dimethylamino)methylphenol | 2.2 parts |
| Graphite | 40.0 parts |

The vibration loss coefficient of this sheet at 20° C. in the frequency range of 50 Hz to 5 kHz was 0.04.

The thus obtained resin sheet was cut to a rectangle sizing 25×800 mm. The weight of the sheet was 5.6 g.

The above-described prepreg sheet was cut to a rectangle sizing about 350×1600 mm and the cut sheet was wound about a tube made of Nylon film. In this case, the resin sheet was wound such that the resin sheet constitutes the second layer from the outer surface and is arranged in the center of the tube so as to prepare a laminated tube.

Then the thus obtained laminated tube was placed in a tennis racket metal mold and the resultant was placed in a curing furnace. Upon the resin is softened, compressed air was blown into the Nylon tube and the resin was cured for 2 hours, followed by removal of the molded article from the metal mold.

The thus obtained molded article had a good outer appearance free from scabs and voids. After removing burrs and grinding the surface, a grip and gut were attached thereto to obtain a tennis racket.

The weight of this tennis racket was 355 g. The apparent vibration loss coefficient of this racket at 20° C. at a resonance frequency of 137.5 Hz was 0.022.

The feeling of hitting the ball with this racket was more comfortable than that with the commercially available rackets or the racket of the comparative example hereinbelow described because the impact and vibration transmitted to the wrist and elbow are smaller.

For comparison, a tennis racket having a conventional structure made of a fiber-reinforced resin was prepared in the same manner as in Example 1 except that the vibration-reducing sheet was not laminated (Comparative Example 1).

The weight of the racket was 349 g. The apparent vibration loss coefficient of this racket measured at 20° C. under a resonance frequency of 142.5 Hz was 0.007. The feeling of hitting a ball with this racket was uncomfortable because the vibration transmitted to the wrist and elbow was large.

EXAMPLES 2–5, COMPARATIVE EXAMPLE 2

As the vibration-reducing material, a resin sheet of 150 μm thickness was prepared from a resin composition having the following composition:

| | |
|---|---|
| Epoxy Resin (Epicoat#828, commercially available from Yuka Shell Co., Ltd.) | 13.6 parts |
| Octadecylglycidyl Ether | 2.7 parts |
| Polyamide Resin (Tomaid#225-X, commercially available from Fuji Kasei Co., Ltd) | 31.9 parts |
| Tris(dimethylamino)methylphenol | 1.8 parts |
| Graphite | 50.0 parts |

The vibration loss coefficient of the sample resin (vibration-reducing material) of this resin composition with a thickness of 10 mm was 0.04 at 20° C. in the frequency range of 50 Hz to 5 kHz.

A prepreg in which bundles of carbon fibers each having a total fineness of 3300 deniers are arranged to attain a weight per a unit area of 139 g/m$^2$ and an epoxy resin of a weight per a unit area of 207 g/m$^2$ was coated thereon to obtain a prepreg. The prepreg was cut such that the fibers are made bias to obtain a Prepreg A.

Another prepreg in which bundles of carbon fibers each having a total fineness of 3300 deniers are arranged to attain a weight per a unit area of 150 g/m$^2$ and an epoxy resin of a weight per a unit area of 244 g/m$^2$ was coated thereon to obtain a prepreg. The prepreg was cut in a short length such that the direction of the fibers is straight to obtain Prepreg B.

Six plies of the Prepreg A were wound about a core which was a steel rod to which a fluorine-containing releasing agent was preliminarily applied, and one ply of the above-described resin sheet which is the vibration-reducing material and four plies of Prepreg B were wound thereon to obtain a laminate (Example 2).

On the other hand, a laminate was prepared by winding the resin sheet which is the vibration-reducing material as a first ply about the same core as mentioned above, winding six plies of Prepreg A thereon and winding four plies of Prepreg B thereon (Example 3).

In addition, a laminate was prepared by winding six plies of Prepreg A about the core, winding thereon four plies of Prepreg B and finally winding thereon the resin sheet which is the vibration-reducing material (Example 4).

In addition, a laminate was prepared by winding six plies of Prepreg A about the core, winding thereon two plies of Prepreg B, winding thereon one ply of the resin sheet which is the vibration-reducing material and finally winding two plies of Prepreg B (Example 5).

For comparison, a laminate was prepared by winding six plies of Prepreg A and by winding thereon four plies of Prepreg B (Comparative Example 2).

The above-described five kinds of laminates were placed in a thermostatic bath of high temperature type and were heated at 135° C. for 2 hours so as to cure and mold the resin. The metal rods were withdrawn from the molded article to obtain five materials for golf club shafts.

The apparent vibration loss coefficients of the materials for golf club shafts are shown in Table 1.

The apparent vibration loss coefficients were those measured at 20° C. at a resonance frequency of 250 Hz.

TABLE 1

| | Apparent Vibration Loss Coefficient |
|---|---|
| Example 2 | 0.014 |
| Example 3 | 0.013 |
| Example 4 | 0.015 |
| Example 5 | 0.034 |
| Comparative Example 2 | 0.002 |

As can be seen from these results, the materials of Examples 2–5, especially that of Example 5 showed excellent impact and vibration-reducing effect.

The feelings of hitting the ball with these rackets were more comfortable than with the racket of Comparative Example 2 because the impact and vibration transmitted to the wrist and elbow are smaller. Especially, the feeling of hitting a ball with the racket of Example 5 was extremely excellent.

EXAMPLES 6–11, COMPARATIVE EXAMPLE 3

Microvibration-inducing elements 52 and 53 concretely shown in FIG. 20 according to the mode shown in FIG. 11(*a*) were prepared. The microvibration-inducing elements 52 and 53 were made of the same material, although six kinds of materials were used. The size of the element 52 was fixed (height 4 mm, length×width=10 mm×20 mm) and the size of the element 53 was controlled so as to attain a total weight of the elements 52 and 53 of 3–20 g.

The flexibilities of the microvibration-inducing elements in terms of 50% modulus values are shown in Table 2. The impact-absorbing elements of these combinations were adhered to the inner side of the shaft portion of a commercially available tennis racket (commercially available from Yonex Co., Ltd., under the tradename of R-22). The vibration loss coefficient of each racket is shown in Table 2.

As can be seen from Table 2, by adhering the impact-absorbing elements of Examples 6–11 according to the present invention, the rackets acquired excellent impact and vibration-reducing effects. In particular, those employing microvibration-inducing elements having 50% modulus values of 10–150 kg/cm$^2$ exhibited extremely excellent impact and vibration-reducing effect.

EXAMPLES 12–15, COMPARATIVE EXAMPLE 4

Four kinds of microvibration-inducing elements according to the mode shown in FIG. 11(*a*) were prepared. The microvibration-inducing elements 52 and 53 of a single impact-absorbing element were made of the same material. However, different microvibration-inducing elements were made of polyurethane resins having different polymerization degrees and, in turn, different 50% modulus values.

The vibration loss coefficients of the polyurethane resins were 0.03, 0.04, 0.03 and 0.02, respectively. Each impact-absorbing element was designed to have a total weight of 15 g.

These impact-absorbing elements each comprising a combination of the same material was adhered to the tennis rackets as in Examples 6–11 and the vibration loss coefficient of each racket was measured in the same manner as mentioned before.

The vibration loss coefficients of the tennis rackets are shown in Table 3.

TABLE 2

| | Material of Vibration-Inducing Element | 50% Modulus (kgf/cm²) | Vibration Loss Coefficients (η) of Rackets Provided with Various Weights of Microvibration-Inducing Element | | | |
|---|---|---|---|---|---|---|
| | | | 3 g | 6 g | 12 g | 20 g |
| Example 6 | Polyester Elastomer | 155.0 | 0.009 (130) | 0.01 (131) | 0.03 (134) | 0.04 (132) |
| Example 7 | Polyrinyl Chloride (DOP60PHR) | 40.1 | 0.01 (130) | 0.02 (131) | 0.05 (133) | 0.13 (136) |
| Example 8 | Nitrile Rubber +EPDM | 19.6 | 0.01 (129) | 0.03 (130) | 0.05 (136) | 0.09 (135) |
| Example 9 | Polyurethane | 10.7 | 0.02 (130) | 0.04 (136) | 0.04 (135) | 0.07 (136) |
| Example 10 | Polyurethane | 0.5 | 0.009 (131) | 0.01 (134) | 0.009 (132) | 0.02 (132) |
| Example 11 | Polyurethane | 0.5 | 0.009 (131) | 0.01 (134) | 0.009 (132) | 0.009 (134) |
| Comparative Example 3 | No Impact-Absorbing Element | — | | 0.006 (122.5) | | |

Values in parentheses indicate resonance frequency (Hz)

EXAMPLES 12–15, COMPARATIVE EXAMPLE 4

Four kinds of microvibration-inducing elements according to the mode shown in FIG. 11(*a*) were prepared. The microvibration-inducing elements 52 and 53 of a single impact-absorbing element were made of the same material. However, different microvibration-inducing elements were made of polyurethane resins having different polymerization degrees and, in turn, different 50% modulus values.

The vibration loss coefficients of the polyurethane resins were 0.03, 0.04, 0.03 and 0.02, respectively. Each impact-absorbing element was designed to have a total weight of 15 g.

These impact-absorbing elements each comprising a combination of the same material was adhered to the tennis rackets as in Examples 6–11 and the vibration loss coefficient of each racket was measured in the same manner as mentioned before.

The vibration loss coefficients of the tennis rackets are shown in Table 3.

TABLE 3

| | 50% Modulus of Polyurethane Resin (kg/cm²) | Vibration Loss Coefficient (η) |
|---|---|---|
| Example 12 | 15.0 | 0.03 (125.0) |
| Example 13 | 33.2 | 0.05 (116.0) |
| Example 14 | 73.4 | 0.02 (118.8) |
| Example 15 | 98.9 | 0.01 (118.8) |
| Comparative Example 4 | No Impact-absorbing Element Used | 0.006 (122.5) |

Values in parentheses indicate resonance frequency (Hz) (20° C.)

EXAMPLES 16–18, COMPARATIVE EXAMPLE 5

According to the mode shown in FIG. 13(*a*), impact-absorbing elements each comprising a microvibration-inducing element (vibration loss coefficient: 0.03, height: 2–5 mm, weight: 10–15 g) made of a thermoplastic polyurethane resin elastomer and a loading element W (specific gravity: 1.21, diameter: 9 mm, height: 2 mm, in the form of a disk) made of epoxy/polyamideamine resin in which metal powder was admixed were prepared. The microvibration-inducing elements were so designed as to have a weight of 10–15 g.

The microvibration-inducing elements were attached to the rackets in the same manner as in Examples 6–11 with varying heights of the neck portions and the vibration loss coefficients were measured. Varying the hardness of the resins (50% modulus) and the heights (mm) of the neck portions of the microvibration-inducing elements, the changes in the apparent vibration loss coefficients of the rackets were examined.

The results are shown in Table 4.

As can be seen from Table 4, the proper vibration loss coefficient values of the microvibration elements are attained by employing a height of the neck portion of not lower than 3 mm. For example, with the impact-absorbing elements made of polyvinyl chloride or nitrile rubber+EPDM, very good vibration loss coefficients were obtained when the height of the neck portion was not lower than 3 mm. In cases where polyurethane was used, good vibration loss coefficients were attained when the height of the neck portion was not lower than 4 mm.

TABLE 4

| | Height of Neck Portion (mm) | Vibration Loss Coefficient (η) | | |
|---|---|---|---|---|
| | | Polyvinyl Chloride (DBP60PHR) (50% Modulus = 45.1 kg/cm²) | Nitrile Rubber +EPDM (50% Modulus = 20.1 kg/cm²) | Polyurethane (50% Modulus = 15.6 kg/cm²) |
| Comparative Example 5 | 2 | 0.006 (134) | 0.008 (133) | 0.009 (134) |
| Example 16 | 3 | 0.02 (132) | 0.02 (134) | 0.01 (132) |
| Example 17 | 4 | 0.06 (133) | 0.04 (135) | 0.03 (134) |
| Example 18 | 5 | 0.06 (132) | 0.05 (134) | 0.04 (132) |

Values in parentheses indicate resonance frequency (Hz)

EXAMPLES 19–22, COMPARATIVE EXAMPLE 6–7

An impact-absorbing element 49 according to the mode shown in FIG. 19 was prepared.

A microvibration-inducing element 51 was made of a thermoplastic polyurethane resin elastomer, which had a height of 3 mm, weight of 2–12 g and a vibration loss coefficient of 0.03.

A loading element 50 is made of an epoxy resin to which metal powder was admixed, which had a specific gravity of 1.30.

The impact-absorbing element 49 was attached to the portion immediately below the grip portion 33 of a golf club 34 (a shaft of a wood driver) as shown in FIG. 15 and the apparent vibration loss coefficient of the golf club was measured. Only one impact-absorbing element was attached to the golf club shaft. The height H of the microvibration-inducing element was 3 mm as mentioned above, and the microvibration-inducing element and the loading element were designed so as to attain various total weights within the range of 2–12 g. The apparent vibration loss coefficients of the rackets were measured.

As shown in Table 5, good loss coefficients were attained when the weight of the microvibration-inducing element was not less than 3 g.

TABLE 5

| | Microvibration-inducing Element | | Vibration Loss Coefficient ($\eta$) | |
|---|---|---|---|---|
| | Weight (g) | Number of Attached Element | Resonance Frequency (Hz) | Loss Coefficient ($\eta$) |
| Comparative Example 6 | 2 | 1 | 211 | 0.006 |
| Example 19 | 3 | 1 | 209 | 0.013 |
| Example 20 | 5 | 1 | 208 | 0.016 |
| Example 21 | 10 | 1 | 206 | 0.029 |
| Example 22 | 12 | 1 | 205 | 0.035 |
| Comparative Example 7 | Not Attached | — | 219 | 0.003 |

EXAMPLES 23 AND 24, COMPARATIVE EXAMPLE 8

An impact-absorbing element 49 according to the mode shown in FIG. 19, which had a total weight of 15 g was prepared.

More particularly, a microvibration-inducing element is made of a polyurethane elastomer which had a height of 3 mm and a weight of 10 g. The loading element W had a specific gravity of 1.30, and an impact-absorbing element with a total weight Of 15 g having the shape shown in FIG. 19 was prepared by combining the microvibration-inducing element and the loading element.

As shown in FIG. 16, an impact-absorbing element 36 or 37 are adhered to the point A which was the junction between the linear portion and the curved tip portion of the ski, and to the point B which was a little closer to the center to the ski than the point A, respectively. A microacceleration pickup 39 was mounted on the center of the footrest and the tip of the ski was lightly hit with a hammer 38. The vibration loss coefficient was measured as in Example 1. The results are shown in Table 6.

As can be seen from these results, good vibration-reducing effects were observed when the impact-absorbing element was attached to either of point A or point B.

Further, skiing was actually performed with these skies. As a result, it was confirmed that the transmission of the impact and vibration to the legs was reduced and the slipping of the skis on the snow was smooth.

TABLE 6

| | | Vibration Loss Coefficient ($\eta$) | |
|---|---|---|---|
| | Attaching Position | Resonance Frequency (Hz) | Loss Coefficient ($\eta$) |
| Example 23 | Point A | 116 | 0.030 |
| Example 24 | Point B | 118 | 0.027 |
| Comparative Example 8 | Not Attached (Blank) | 114 | 0.014 |

EXAMPLES 25–26, COMPARATIVE EXAMPLE 9

The impact-absorbing elements employed in Examples 23 and 24 were provided.

One or two of these were attached to a commercially available metal bat as shown in FIG. 17 and the apparent vibration loss coefficients were measured by the method described above. The results are shown in Table 7.

As can be seen from Table 7, prominent impact-reducing effects were observed with the bats to which the impact-absorbing element of the present invention was attached, which were 4 to 6 times longer than that of the bat to which the impact-absorbing element was not attached.

TABLE 7

| | Number of Attached Element | Resonance Frequency (Hz) | Vibration Loss Coefficient ($\eta$) |
|---|---|---|---|
| Example 25 | 1 | 781 | 0.008 |
| Example 26 | 2 | 782 | 0.013 |
| Comparative Example 9 | Not Attached (Blank) | 776 | 0.002 |

EXAMPLES 27–28, COMPARATIVE EXAMPLE 10

The impact-absorbing elements employed in Examples 25 and 26 were provided. These elements were attached to commercially available fishing rods for throwing and to fishing rods for lure fishing, and the apparent vibration loss coefficient of each fishing rod was determined by the method described above.

The results are shown in Table 8.

As is apparent from Table 8, by attaching the impact-absorbing element according to the present invention, good vibration-reducing effect was obtained.

TABLE 8

| | | Fishing Rod for Throwing | | Fishing Rod for Lure Fishing | |
|---|---|---|---|---|---|
| | Attachment of Impact-absorbing Element | Frequency in Measurement (Hz) | Loss Coefficient ($\eta$) | Frequency in Measurement (Hz) | Loss Coefficient ($\eta$) |
| Example 27 | One Element Attached | 337.0 | 0.025 | 223.4 | 0.040 |
| Example 28 | Two Element Attached | 330.2 | 0.029 | 224.7 | 0.045 |

TABLE 8-continued

| | Attachment of Impact-absorbing Element | Fishing Rod for Throwing | | Fishing Rod for Lure Fishing | |
|---|---|---|---|---|---|
| | | Frequency in Measurement (Hz) | Loss Coefficient ($\eta$) | Frequency in Measurement (Hz) | Loss Coefficient ($\eta$) |
| Comparative Example 10 | None | 337.5 | 0.007 | 223.8 | 0.015 |

INDUSTRIAL FIELD OF THE INVENTION

The present invention provides sports instruments with which the impact or vibration transmitted to the body such as arms or legs of a user when the instrument is used is largely reduced, and an impact-absorbing element which is used by being mounted on sports instruments.

According to the present invention, disorders caused by sports such as tennis elbow can be prevented and the sports can be enjoyed, so that the population of the lovers of various sports will be increased.

As a result, the demand of the sports instruments will largely be increased.

We claim:

1. A golf club having a vibration-reducing material embedded therein, the vibration-reducing material having a vibration loss coefficient of not less than 0.01 at room temperature, wherein said vibration-reducing material is a thermally cured material having the following components as major constituents:

(a) an epoxy resin which possesses flowability at a temperature between room temperature and 100° C., (b) a polyamide resin which possesses flowability at a temperature between room temperature and 100° C., and (c) an inorganic filler selected from the group consisting of graphite, ferrite and mica.

2. The golf club of claim 1, wherein the vibration loss coefficient at room temperature is not less than 0.02.

3. The golf club of claim 1, wherein said vibration-reducing material is a thermally cured material containing the following components as major constituents thereof:

(a) an epoxy resin which possesses flowability at a temperature between room temperature and 100° C.;

(b) a polyamide resin which possesses flowability at a temperature between room temperature and 100° C.; and (c) an inorganic filler selected from the group consisting of graphite, ferrite and mica.

4. The golf club of claim 1, wherein said vibration-reducing material is in the form of a sheet, plate, line, block, net or ribbon, and wherein said vibration-reducing material is composited with a resin layer which is reinforced with fibers.

5. The golf club of claim 4, wherein said resin layer reinforced with fibers is arranged adjacent to or in the vicinity of said vibration-reducing material.

6. The golf club of claim 4, wherein said resin layer which is reinforced with fibers is a prepreg containing carbon fibers as at least a part of said fibers.

7. The golf club of claim 4, wherein said vibration-reducing material is composited with said resin layer which is reinforced with fibers so as to form a substantially hollow structure, thereby constituting said sports instrument.

8. The golf club of claim 4, wherein the resin constituting said resin layer which is reinforced with fibers is a thermosetting resin.

9. The golf club of claim 8, wherein said thermosetting resin is an epoxy resin.

10. The golf club of claim 8, wherein said thermosetting resin is an unsaturated polyester resin.

* * * * *